US007740121B2

(12) United States Patent
Biermann et al.

(10) Patent No.: US 7,740,121 B2
(45) Date of Patent: Jun. 22, 2010

(54) COIN CHANGER WITH IMPROVED FUNNEL DESIGN

(75) Inventors: Wayne T. Biermann, Brentwood, MO (US); Michael A. Nogin, St. Louis, MO (US)

(73) Assignee: Coin Acceptors, Inc., St. Louis, MO (US)

( * ) Notice: Subject to any disclaimer, the term of this patent is extended or adjusted under 35 U.S.C. 154(b) by 457 days.

(21) Appl. No.: 11/247,462

(22) Filed: Oct. 11, 2005

(65) Prior Publication Data

US 2007/0080043 A1 Apr. 12, 2007

(51) Int. Cl.
*G07F 1/00* (2006.01)
*G07F 1/02* (2006.01)

(52) U.S. Cl. ..... 194/351; 193/DIG. 1

(58) Field of Classification Search ..... 194/351, 194/344; 232/44
See application file for complete search history.

(56) References Cited

U.S. PATENT DOCUMENTS 4,342,405 A * 8/1982 Croley ..... 222/105
4,650,057 A 3/1987 Koester
4,757,915 A * 7/1988 Albright et al. ..... 221/75
5,090,548 A 2/1992 Hird et al.
5,487,459 A * 1/1996 Farmont ..... 194/213
6,039,165 A 3/2000 Wild
6,041,908 A * 3/2000 Delmenico et al. ..... 194/348
6,609,966 B1 * 8/2003 Kurosawa et al. ..... 453/57
2004/0074737 A1 * 4/2004 Yang ..... 194/338

OTHER PUBLICATIONS

United Kingdom Patent Application No. 0620070.3 Search Report (3 pages), dated Feb. 23, 2007.

* cited by examiner

*Primary Examiner*—Patrick Mackey
*Assistant Examiner*—Mark Beauchaine
(74) *Attorney, Agent, or Firm*—Polster, Lieder, Woodruff & Lucchesi, LC

(57) ABSTRACT

A coin changer having a funnel portion, a coin changer body, and an acceptor removably mounted to the coin changer body. The funnel portion has a front funnel portion, two side funnel portions and a rear funnel portion. The rear funnel portion is attached to the coin changer body and the front funnel portion is attached to the acceptor.

14 Claims, 3 Drawing Sheets

COIN CHANGER WITH IMPROVED FUNNEL DESIGN

FIELD OF THE INVENTION

The present invention relates to a multiple coin changer. More specifically, the invention relates to a multiple coin changer that allows the acceptor portion to be more easily removed from the changer.

BACKGROUND OF THE INVENTION

Vending machines typically include coin changer devices for accepting coins of different denominations. These coin changer devices function to authenticate each of the coins inserted into the vending machine and to determine the denomination of each of the coins. Once this function is accomplished the coins are routed within the coin changer device to one of three possible destinations. The first destination, assuming the coin has been determined to be acceptable, is to a coin tube where the coin may be stored for subsequent payout or escrow purposes. The second possible destination, again assuming the coin is acceptable and the coin tube to which it should be routed is full, is to a cash box for later retrieval by a route man or other service personnel. A coin which is deemed unacceptable is typically returned to the customer via a coin return cup associated with the vending machine.

The acceptor portion of the changer is usually designed as a separate module that performs coin validation and routing functions. This module is connected to the changer mechanically and electrically with ease of installation and removal in mind. Presently, when a technician needs to remove the acceptor from the coin changer while the changer is installed in a vending machine, the chute that feeds coins into the changer often must be moved or disassembled. This is because the chute can extend into the funnel of the acceptor to prevent jams or coins inadvertently leaving their proper path. This causes the process of replacing the acceptor to take additional time in order to complete the additional steps. Therefore, there is a need for a coin changer that allows the removal of the acceptor when the changer is installed in a vending machine that does not require a technician to move, disassemble or remove the coin chute.

SUMMARY OF THE INVENTION

The present invention comprises a coin changer comprising a funnel portion, a coin changer body, and an acceptor removably mounted to the coin changer body. The funnel portion has a front funnel portion, two side funnel portions and a rear funnel portion. The rear funnel portion is attached to the coin changer body and the front funnel portion is attached to the acceptor.

DESCRIPTION OF THE PREFERRED EMBODIMENT

Figure 1:
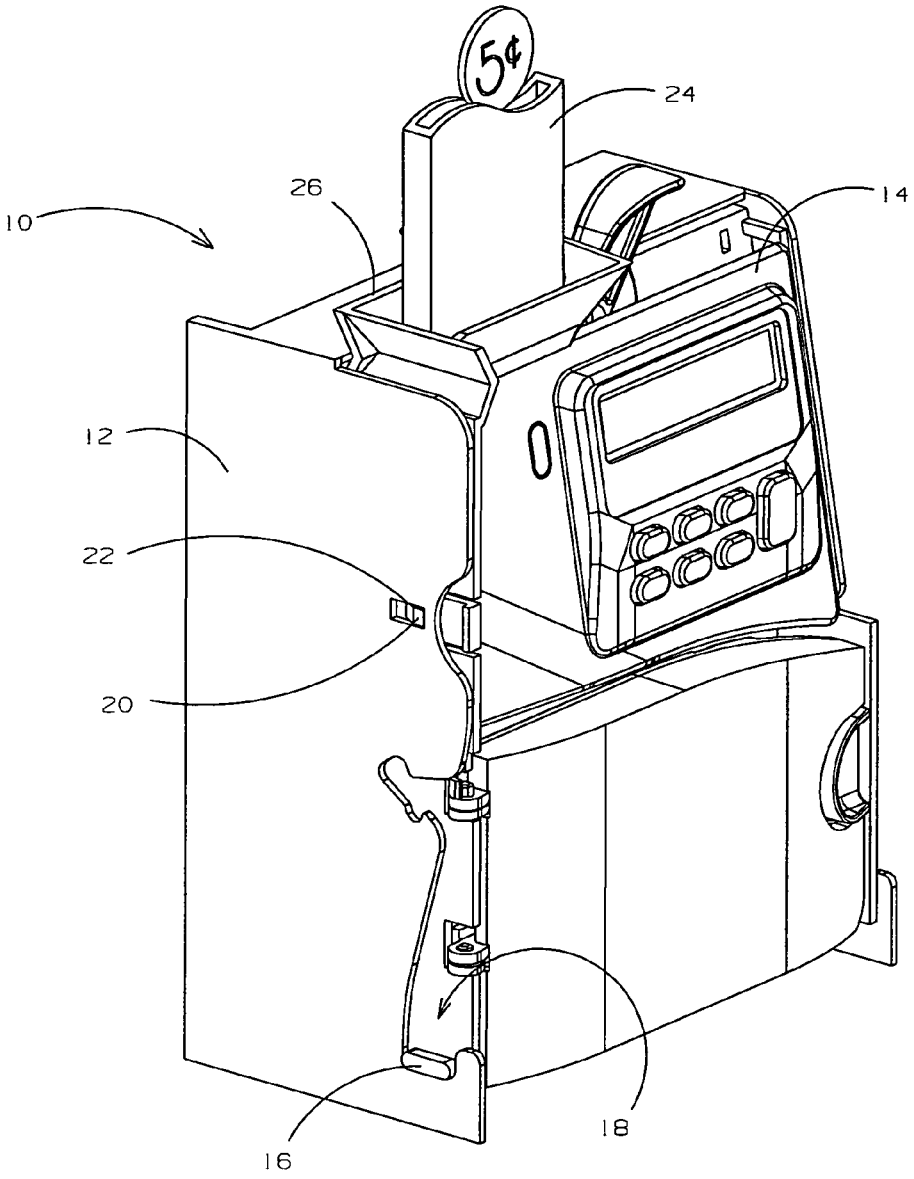
Fig. 1 PRIOR ART
FIG. 1 is a front perspective view of a coin changer according to the prior art.
Figure 3:
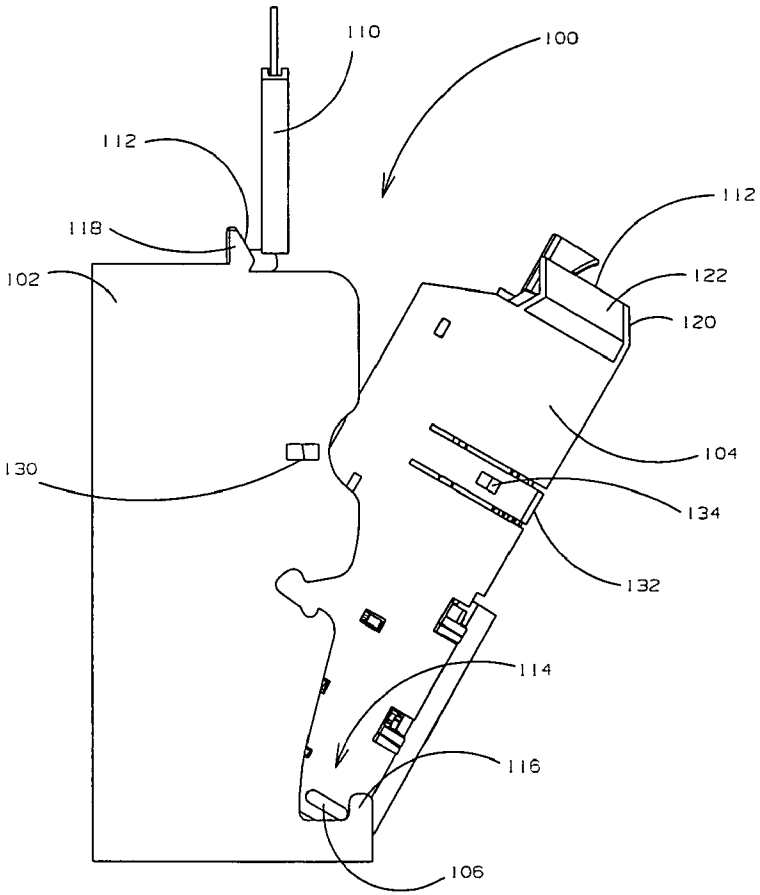
FIG. 3 is a side view of a coin changer according to an embodiment of the present invention.
Figure 2:
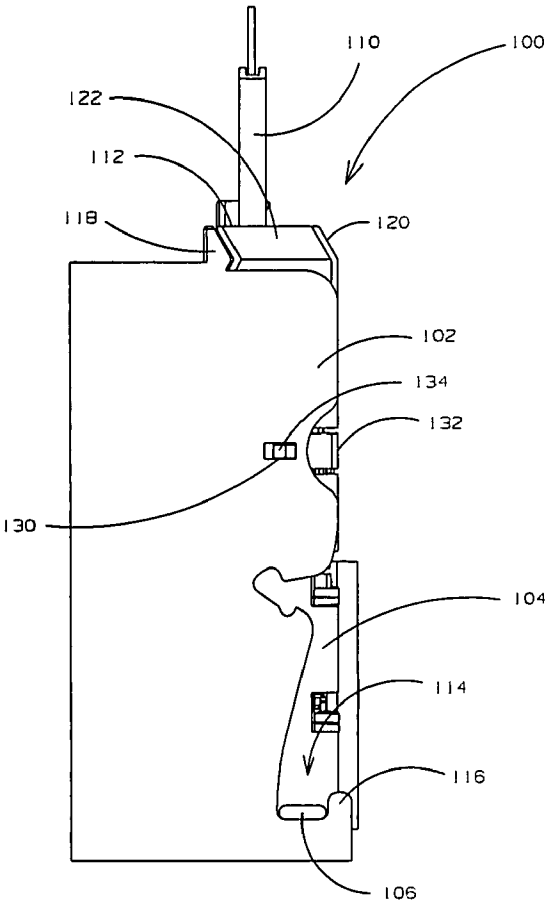
FIG. 2 is a side view of a coin changer according to an embodiment of the present invention.
Figure 5:
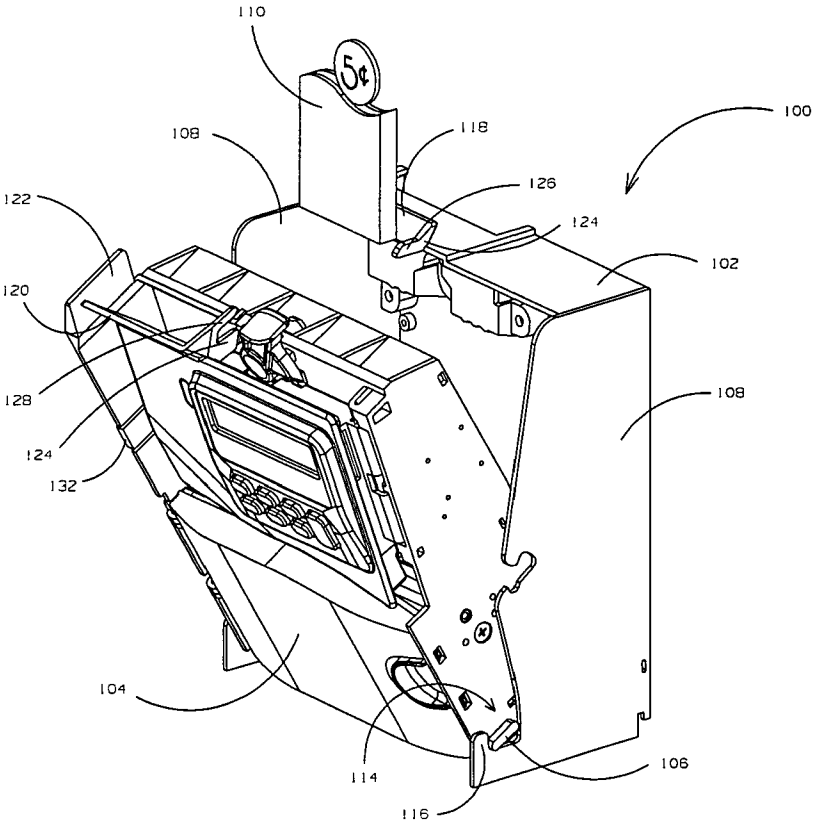
FIG. 5 is a front perspective view of a coin changer according to an embodiment of the present invention.
Figure 4:
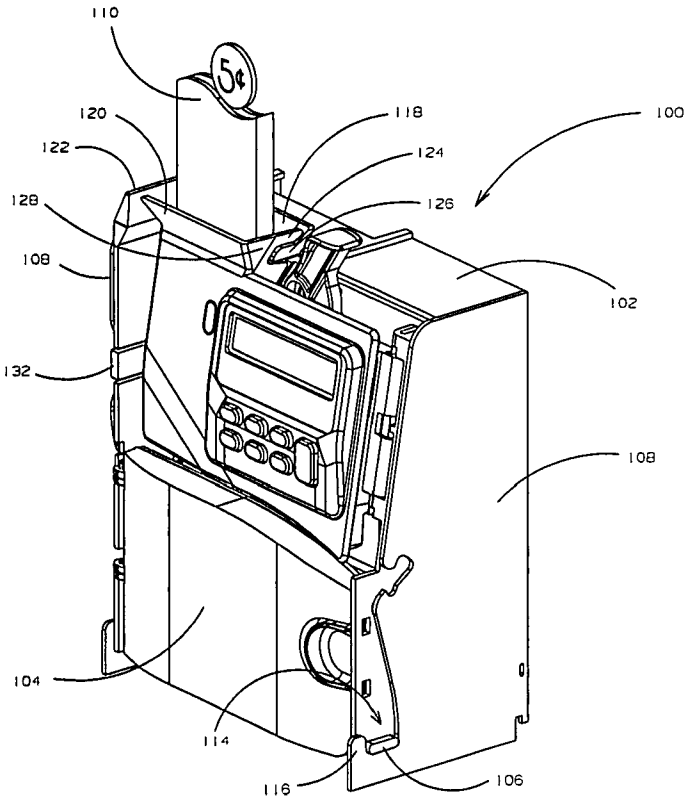
FIG. 4 is a front perspective view of a coin changer according to an embodiment of the present invention.

While this invention is susceptible of embodiment in many different forms, there is shown in the drawings and will herein be described in detail preferred embodiments of the invention with the understanding that the present disclosure is to be considered as an exemplification of the principles of the invention and is not intended to limit the broad aspect of the invention to the embodiments illustrated.

Coin changers are known in the art and are almost universally used in vending machines to accept and validate coins as well as provide correct change to purchasers. The present invention pertains not to the operation of a coin changer, but rather its physical construction. As a result, the present invention can be implemented on various coin changers that operate in vastly different ways. Therefore, the internal operation of the coin changer will not be discussed, although such operation would be readily understood by one of ordinary skill in the art.

Referring to FIG. 1, a prior art coin changer 10 comprises a coin changer body 12 that is mounted within a vending machine and an acceptor 14. The acceptor 14 includes extensions 16 on opposite sides thereof that are mounted within slots 18 located in opposite sides of the body 12, as well as a resilient tab 20 on the acceptor 14 that is maintained within a cutout 22 of the body 12. By biasing the tab 20 inwardly such that it is no longer within the cutout 22, the acceptor 14 may be rotated outwardly about the extensions 16 and then lifted upwardly from the coin changer body 12.

By reversing the process the acceptor 14 may be reinstalled into the coin changer body 12. However, a coin chute 24 that supplies coin accepted from a customer typically must extend close to or into a funnel 26 of the acceptor 14 to prevent the coins from getting jammed or leaving the coin path. Therefore, in order to rotate the acceptor 14 from the coin changer body 12 to remove it, the coin chute 24 must be moved away from funnel 26.

In the present invention, the deficiencies of the prior art are overcome. In a preferred embodiment and referring to FIGS. 2-5, the present invention comprises a coin changer 100. The coin changer 100 generally comprises a coin changer body 102 and an acceptor 104. The coin acceptor body 102 is mounted within a vending machine, and the acceptor 104 is mounted within the coin changer body 102. A coin chute 110 supplies coins to the acceptor 104 and the chute extends into a funnel 112 formed by the coin changer body 102 and the acceptor 104, as further explained below.

As with the prior art, the acceptor comprises a pair of extensions 106. The extensions rest within slots 114 formed within two opposed sidewalls 108 of the coin changer body 102. The slots 114 preferably also have an upwardly extending protuberance 116 which captures the extensions 106 within the slot 114.

The funnel 112 of the coin changer body 102 further comprises a rear funnel portion 118, and the acceptor 104 comprises a front funnel portion 120 opposite the rear funnel portion 118. A first side funnel portion 122 of the funnel 112 is attached to the acceptor 104 and a second side funnel portion 124 of the funnel 112 comprises a first extension 126 attached to the coin changer body 102 and a second extension 128 attached to the acceptor 104. Alternatively, the first and second side funnel portions 122 and 124 may each comprise a single portion and be attached to the acceptor 104 or the coin changer body 102.

The coin changer body 102 further comprises a cutout 130, and the acceptor 104 comprises a resilient tab 132 having a protuberance 134. When the protuberance 134 of the resilient tab 132 is located within the cutout 130 and the extensions 106 located within the slots 114, the acceptor 104 is fixedly attached to the coin changer body 102.

The acceptor 104 may be easily removed from the coin changer body 102 for cleaning, repair or replacement while installed in a vending machine. This is accomplished by urging the resilient tab 132 inwardly such that the protuberance 134 of the resilient tab 132 is no longer within the cutout 130. The acceptor 104 may then be rotated about the extensions 106 to the position shown in FIGS. 3 and 5. Next, the acceptor 104 may be lifted to remove the extensions 106 from the slots 114 to disassociate the acceptor 104 from the coin changer body 102 and the vending machine. The acceptor 104 may be reinstalled by reversing the steps of removal.

Because the rear funnel portion 118 is attached to the coin changer body 102 rather than the acceptor 104, it does not interfere with the chute 110 when the acceptor 104 is removed. As a result, the chute 110 does not need to be moved or removed from the position it is mounted when the acceptor 104 removed. This results in substantial time savings for personnel charged with maintaining the vending machine.

While the specific embodiments have been illustrated and described, numerous modifications come to mind without significantly departing from the spirit of the invention, and the scope of protection is only limited by the scope of the accompanying claims.

We claim:

1. A vending machine comprising a coin changer, the coin changer comprising a coin changer body attached to the vending machine and an acceptor mounted to the coin changer body, the coin changer further comprising a funnel portion and the vending machine comprising a coin chute that extends close to or into the funnel portion, the funnel portion having a front funnel portion, two side funnel portions and a rear funnel portion, the rear funnel portion being attached to the coin changer body such that when the acceptor is removed from the coin changer body, the rear funnel portion does not interfere with coin chute.

2. The vending machine of claim 1 wherein the side funnel portions are attached to the acceptor.

3. The vending machine of claim 1 wherein the side funnel portions are attached to the coin changer body.

4. The vending machine of claim 1 wherein one side funnel portion is attached to the acceptor and the other side funnel portion is attached to the coin changer body.

5. The vending machine of claim 1 wherein at least one of the side funnel portions comprises a first extension attached to the acceptor and a second extension attached to the coin changer body.

6. The vending machine of claim 1 wherein the acceptor comprises at least two extensions that are rotatingly mounted with corresponding slots in the coin changer body act to removably mount the acceptor to the coin changer body.

7. The vending machine of claim 1 wherein the acceptor comprises a resilient tab having a protuberance thereon that may be captured by a corresponding cutout within the coin changer body that together act to removably mount the acceptor to the coin changer body.

8. A coin changer comprising:

a funnel portion;

a coin changer body;

an acceptor removably mounted to the coin changer body; and wherein the funnel portion has a front funnel portion, two side funnel portions and a rear funnel portion, the rear funnel portion being attached to the coin changer body and the front funnel portion being attached to the acceptor.

9. The coin changer of claim 8 wherein the side funnel portions are attached to the acceptor.

10. The coin changer of claim 8 wherein the side funnel portions are attached to the coin changer body.

11. The coin changer of claim 8 wherein one side funnel portion is attached to the acceptor and the other side funnel portion is attached to the coin changer body.

12. The coin changer of claim 8 wherein at least one of the side funnel portions comprises a first extension attached to the acceptor and a second extension attached to the coin changer body.

13. The coin changer of claim 8 wherein the acceptor comprises at least two extensions that are rotatingly mounted with corresponding slots in the coin changer body to acts to removably mount the acceptor to the coin changer body.

14. The coin changer of claim 8 wherein the acceptor comprises a resilient tab having a protuberance thereon that may be captured by a corresponding cutout within the coin changer body that together act to removably mount the acceptor to the coin changer body.

* * * * *